United States Patent [19]

Duncan et al.

[11] 4,360,189

[45] Nov. 23, 1982

[54] QUENCH PRESS

[76] Inventors: James P. Duncan, P.O. Box 6069, Spartanburg, S.C. 29304; James L. Lawson, 7300 Cedar Post Rd., Bldg. I-23, Liverpool, N.Y. 13088

[21] Appl. No.: 172,865

[22] Filed: Jul. 28, 1980

[51] Int. Cl.[3] ..... C21D 9/32

[52] U.S. Cl. ..... 266/118; 100/93 RP

[58] Field of Search ..... 266/117, 118; 100/93 RP; 148/143

[56] References Cited

U.S. PATENT DOCUMENTS 3,007,823 11/1961 Adair et al. ..... 266/118 X 3,170,975 2/1965 Bauer et al. ..... 266/118

*Primary Examiner*—G. Peters

*Attorney, Agent, or Firm*—Wellington M. Manning, Jr.; Luke J. Wilburn, Jr.

[57] ABSTRACT

A universal quench press is used for the precision quenching of gears, bearing rings, saw blades, slitting knives, cylindrical parts, flat parts, dished parts, and other articles. A set of quenching dies reduce or eliminate the distortions in size, roundness, taper, and flatness encountered in manufacturing processes prior to the press quenching process and/or operation. The press has a plurality of posts or tie-rods configured to distribute the forces of the applied loads uniformly. Provisions are made for a plurality of generally concentric rams with all of the rams powered by hydraulic or pnuematic cylinders or other force exerting device or devices to provide a uniform and evenly distributed force. An automatic quench media splash guard seals the quenching chamber during operation and requires absolutely no set-up or operating adjustments or changes. Two or more automatic doors provide complete access to the die area during set-up and/or allow two or more points for loading and/or unloading of workpieces and/or tooling. For ultimate accuracy, the lower die plate is stationary and provides a means of guiding the center ram, thus assuring concentricity. Graduated shims are added or removed from the center ram stop to decrease or increase the final part bore diameter as required.

18 Claims, 9 Drawing Figures

QUENCH PRESS

BACKGROUND OF INVENTION

This invention relates to the improvements in quench presses used for the precision quenching of gears, bearing rings, and other flat and/or cylindrical shaped parts. Generally, the quench press is used to help correct the distortions that exist in a part immediately prior to the press quenching operation. Additional distortions that are caused by the actual quenching process itself are also minimized.

Obtaining a minimum amount of distortion is very critical in the production of gears, bearing rings and other articles. In practice, an allowance of extra material on the part is made in the before-heat treat condition to help insure that the part can be finished after heat treatment to the proper sizes and requirements for roundness, taper, and flatness. If too little allowance is made, or if the part distorts more than predicted, then the part is many times scrapped. If an excessive allowance is made, then the time and/or cost for grinding, lapping, or sizing by other methods increases and thus becomes an even more expensive operation. Press quenching helps the manufacturer minimize the amount of extra material on the part(s) prior to heat treating to minimize the cost of subsequent material removal operation needed to obtain the desired final dimensions. For carburized parts, it is very critical to minimize the distortion existing in a part after heat treatment, so that the material removed from the part in the subsequent sizing operations will leave a uniform effective case-depth on the part. The ability to minimize any distortions existing in the part after heat treatment by using a quench press can reduce the total time required for carburizing because the parts will not have to be carburized to a deeper depth to help insure that the part will have a sufficient case depth where required after the part's final sizing operations are completed. If no material is removed from the part after heat treating, a quench press can help the manufacturer produce a part with less distortions, and therefore, more dimensionally correct.

In most prior art quench presses, the frame of the machine requires heavy and expensive castings or weldments which subsequently require very accurate machining. Additionally, the nonsymmetrical configurations allow misalignment, as the frame deflects from forces involved with the quenching operation. Also in the prior art quench presses, specially designed and manufactured power cylinders would have to be used to obtain unique forces to drive three totally independent concentric rams. These cylinders would be such that they are concentric to each other and pose many problems with sealing and mounting and would be expensive to repair or replace. Also, in the prior art quench presses capable of handling parts larger than 24 inches in diameter, either the lower die plate or the upper die plate and/or rams are made to swing away and thus have a tendency of misalignment. Also in the prior art quench presses it is necessary to change and/or adjust the splash guards or guard for various heights or workpieces at much expense of time and labor, plus the inconvenience of storing and stocking a multiple of splash guards and related fasteners. Also in the prior art quench presses, the bore diameter adjustment is difficult or omitted entirely. One such bore diameter adjusting device uses a threaded spacer nut that is not accessible, is not accurate, but is easily damaged to the point that adjustments are very difficult. Also in the prior art quench presses, access to remove the part from the press has been limited since there is generally only one door or access provided. Also in the prior art quench presses, the proper quenching cycle is not available because no means of delaying the introduction of the quenching media to the quenching chamber were included.

SUMMARY OF THE INVENTION

The present invention offers a novel means for overcoming one or more of the problems as set forth above.

According to the present invention, the preferred embodiment of the quench press utilizes a novel arrangement of a plurality of posts or tie-rods with a plurality of horizontal plates such that the posts or tie-rods are equally spaced around the centerline of the quench press so that they absorb the forces, deflections, and thermal expansions of the quenching operation in an equal manner. Such forces, deflections, and expansions do not cause misalignment of the rams to the lower die plate.

Also according to the present invention, the preferred embodiment of the quench press has an arrangement of three concentric rams, each ram being independent and individually controlled as to the force applied, the speed at which the rams move, the number of times that the force or forces are applied, and the amount of time that the force or forces are applied. Each of the rams, other than the center ram, is powered by a plurality of hydraulic or pneumatic cylinders or other force exerting devices that are spaced in such a manner that the forces are evenly distributed. This novel application in the preferred embodiment of inexpensive and relatively common hydraulic or pneumatic cylinders and/or other force exerting devices offers easy repair and replacement and does not tend to cause misalignment of the rams to the lower die plate.

Also according to the present invention, the preferred embodiment of the quench press provides a means of having more than one door or access area to the die or tooling area for installation and/or removal of the tooling and/or operation of the quench press. The preferred embodiment of the quench press will utilize three such doors but the scope of the invention is not limited to three doors or access areas.

Also according to the present invention, the preferred embodiment of the quench press provides for an automatic splash guard that requires neither changes nor adjustments for set-up of various heights of workpieces. Said guard is generally held closed during the quenching process by a plurality of hydraulic or pneumatic cylinders or other force exerting devices such that the position of the splash guard is caused to be adjusted by the movement of the outer die holder or ram.

In the preferred embodiment, said ram is the third or outer ram.

Also according to the present invention, the preferred embodiment of the quench press incorporates a fixed or stationary lower tooling or die plate to insure positive alignment of the rams to the lower tooling or die plate. This accurate alignment is helpful in producing workpieces that are more dimensionally correct.

Also according to the present invention, the preferred embodiment of the quench press incorporates a novel means of adjusting the diameter of the workpiece by adding or removing graduated and properly sized shims or other devices to the positive stop for the center ram such that the bore diameter of the workpiece is decreased or increased as required. The preferred embodiment is to add or remove the shims or other devices from the immediate vicinity of the lower die plate and not from the center ram or its means of transmitting force. Also according to the present invention, the preferred embodiment of the quench press has a novel means of delaying the introduction of the quenching media to the quenching chamber.

As can be seen by the above description, the present invention provides a substantial improvement in the quench press design and operation. These improvements offer reduced manufacturing and maintenance costs by allowing the use of less expensive components and members while still improving and maintaining more accurate alignment. More access to the tooling area and the various components allows easier and faster tooling changes.

In addition, provisions are made to enclose the quench press, to control the flow of quench oil or other quenching media to the workpiece, and to control the force or movements of the various rams.

BRIEF DESCRIPTION OF THE DRAWING FIGURES

DETAILED DESCRIPTION OF THE QUENCH PRESS IN ACCORDANCE WITH THE PRESENT INVENTION IN THE PREFERRED EMBODIMENT

Figure 1:
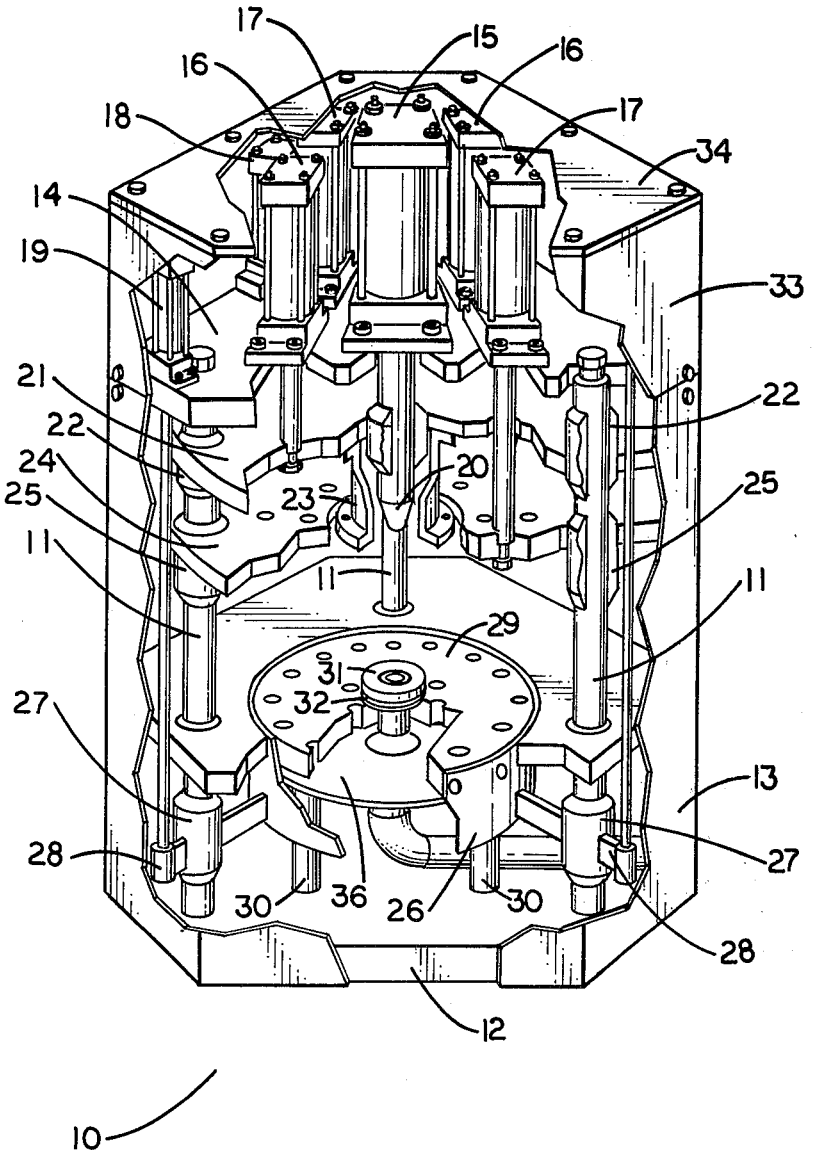
FIG. 1 is a perspective cut-away view showing the quench press in accordance with the present invention in the preferred embodiment.
Figure 2:
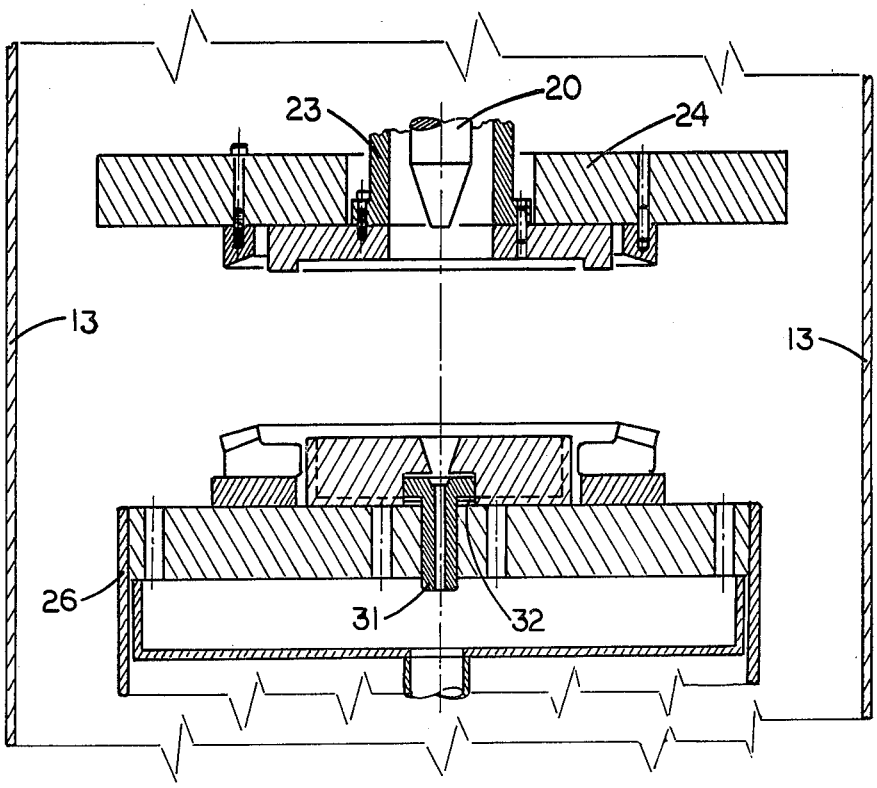
FIG. 2 is a front sectional view showing the die or tooling area in an open or load/unload position of the quench press in accordance with the present invention in the preferred embodiment.
Figure 5:
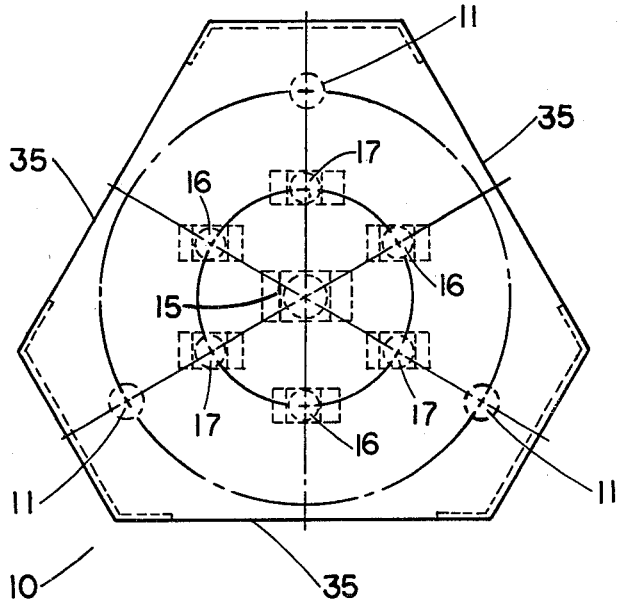
FIG. 5 is a top view showing the quench press in accordance with the present invention in the preferred embodiment.
Figure 6:
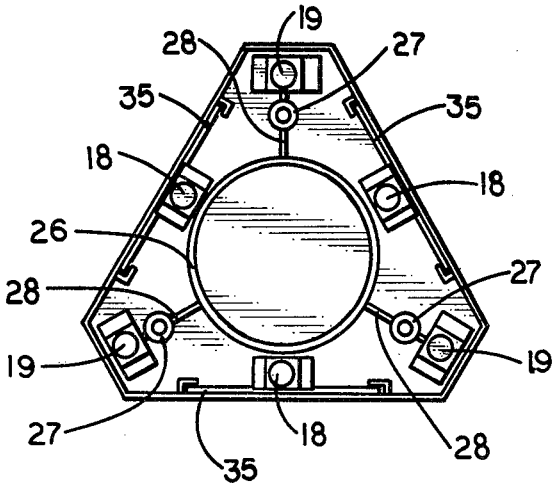
FIG. 6 is a partial top view showing the splash guard and doors of the quench press in accordance with the present invention in the preferred embodiment.
Figure 7:
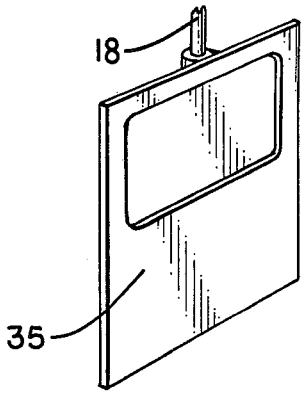
FIG. 7 is a perspective view showing one of the doors of the quench press in accordance with the present invention in the preferred embodiment.
Figure 8:
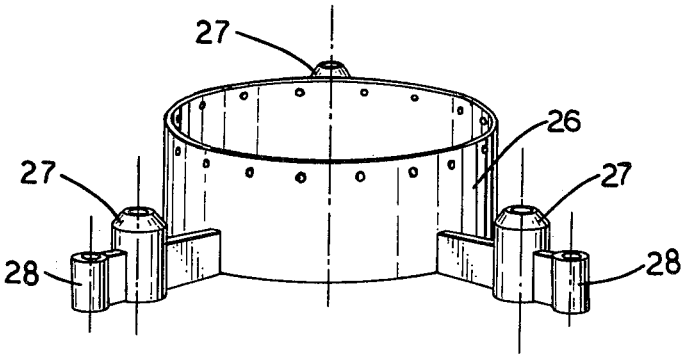
FIG. 8 is a perspective view showing the splash guard of the quench press in accordance with the present invention in the preferred embodiment.
Figure 9:
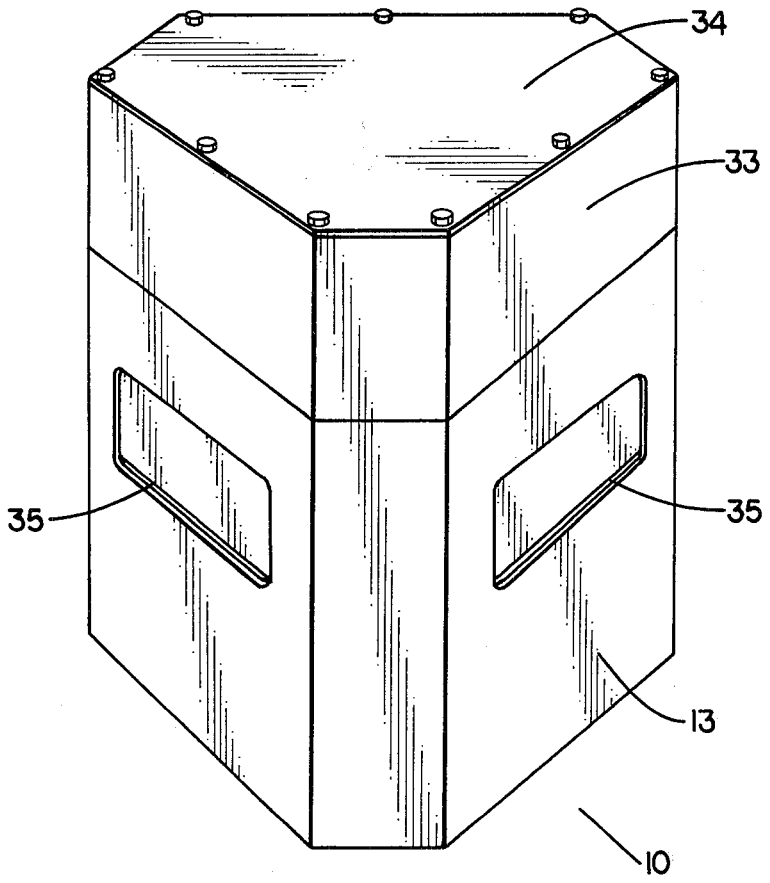
FIG. 9 is a perspective view of the quench press in accordance with the present invention in the preferred embodiment.

Averting first to FIG. 1, there is illustrated therein a quench press 10 in accordance with the present invention. The press 10 has three vertical posts 11 which absorb the thrust forces of the quenching processes. The three posts 11 are attached to the stationary lower plate 12 that acts as a base for the quench press 10 and also provides a member to which the walls 13 are attached. Another stationary plate 14 is mounted to the upper end of the three vertical posts 11. The plate 14 also serves as a mounting position for cylinder 15, three of cylinders 17, three of cylinders 16, three of cylinders 18, and three of cylinders 19. The arrangement of said cylinders in the preferred embodiment is more readily apparent by reference to FIGS. 5 and 6.

The center ram 20 is attached to one of the cylinders, namely cylinder 15, and expands a conventional segmented quenching die under the impetus of cylinder 15. Three cylinders 16, equally spaced around the centerline of the quench press 10 in such a manner as to share the quenching thrust forces uniformly and equally, are attached to a moveable plate 21. The moveable plate 21 is accurately guided by the three vertical posts 11 by means of precision bushings 22 wherein said bushings 22 are rigidly fixed to the moveable plate 21 and wherein said bushings 22 are free to reciprocate vertically along the three vertical posts 11. The moveable plate 21 is further attached to and rigidly mounted to a ram 23 wherein provisions are made to attach a conventional die or adapter plate. Also, three additional cylinders 17, equally spaced around the centerline of the quench press 10 in such a manner as to share the quenching thrust forces uniformly and equally, are attached to a moveable plate 24. The moveable plate 24 is accurately guided by the three vertical posts 11 by means of precision bushings 25 wherein said bushings 25 are rigidly fixed to the moveable plate 24 and wherein said bushings 25 are free to reciprocate vertically along the three posts 11. The moveable plate 24 is also referred to as a ram and herein said plate 24 has provisions for attaching a conventional die or adapter plate.

The quench oil splash guard 26 is held in contact with the outer ram, previously referred to as a moveable plate 24, by means of three cylinders 19, equally spaced around the centerline of the quench press 10 in such a manner as to share the thrust forces uniformly and equally. Three precision bushings 27 accurately guide the lifting arms 28 which are rigidly fixed to the splash guard 26 and to the three cylinders 19.

A stationary plate serves as the lower die plate 29 and is attached to the base 12 of the quench press 10 by means of the three short vertical posts 30 wherein all are rigidly secured. The three short vertical posts 30 are equally spaced around the centerline of the quench press 10 in such a manner as to share the loads uniformly and equally. The lower die plate 29 has provisions for mounting conventional dies and also has passages provided for flow of the quenching media.

Figure 3:
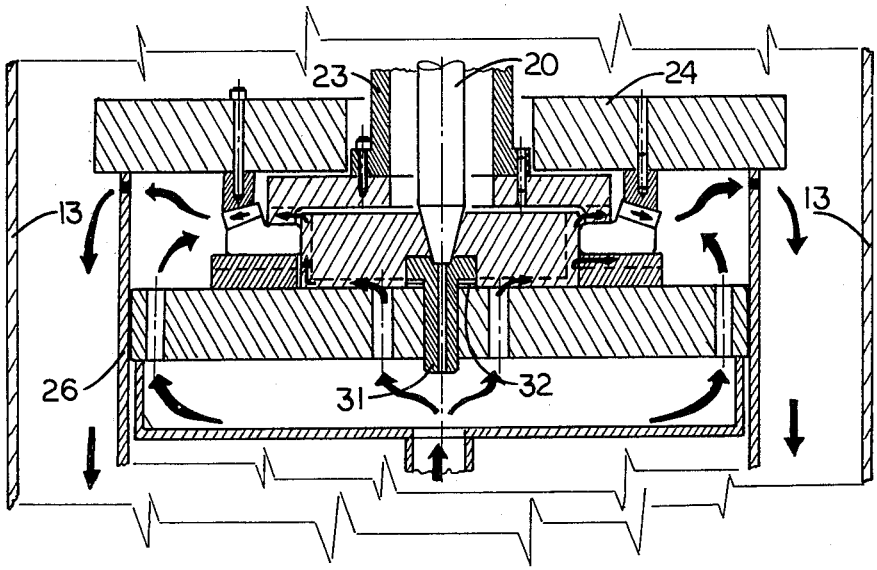
FIG. 3 is a front sectional view showing the die or tooling area in the closed or quenching position of the quench press in accordance with the present invention in the preferred embodiment. Quench oil or other quenching media flow is indicated by the heavy arrows.
Figure 4:
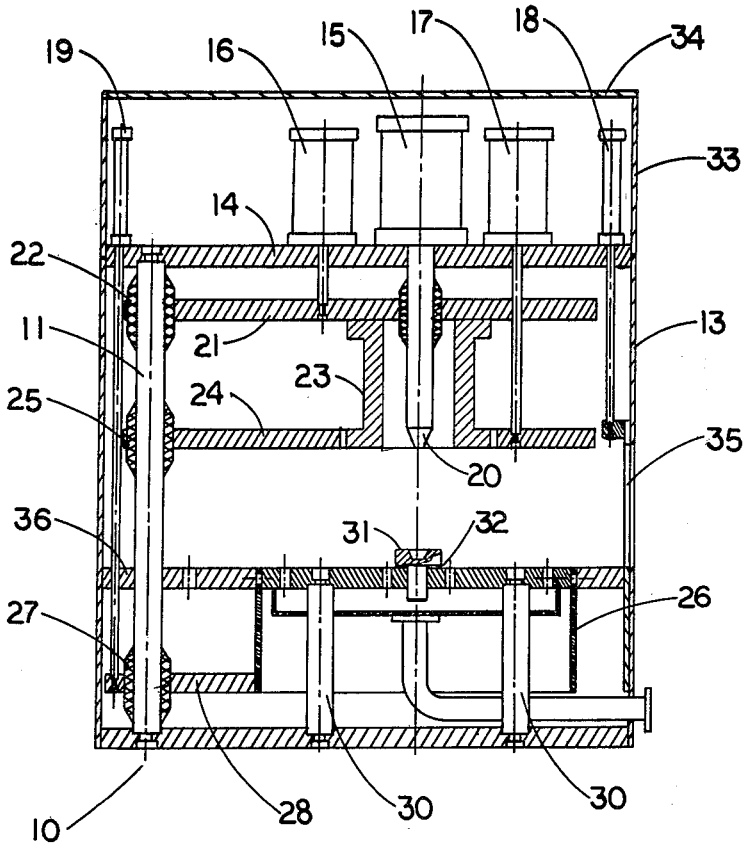
FIG. 4 is a front sectional view showing the quench press in accordance with the present invention in the preferred embodiment.

The quench press 10 in the preferred embodiment has a positive stop 31 that also serves as a guide to insure positive alignment of the center ram 20 while in the closed or quenching position. A female conical surface of the positive stop 31 engages a corresponding male conical surface of the center ram 20. Graduated and properly sized shims 32 are added or removed from the positive stop 31 as required to decrease or increase, respectively, the bore diameter of the article being quenched. The operation of the shims 32 can better be visualized by reference to FIG. 3. A change in the vertical position of the center ram 20, because of the matching conical surface of the quenching die, will cause a change in the bore diameter of the article being quenched in a manner in proportion to the tangent function of the conical angle of the center ram 20.

The quench press 10 in the preferred embodiment has a removeable top 34 and cap 33 for access to all of the cylinders for the purpose of replacement or service or components enclosed in by the top 34 or cap 33.

The quench press 10 in the preferred embodiment has provisions for three doors 35 for loading and/or unloading, and set-up, and are actuated by three cylinders 18 and said doors 35 being free to move in a vertical direction. Provisions are made to control any of three doors 35 independently.

The quench press 10 in the preferred embodiment has provisions for the delay of the introduction of the quenching media to the quenching chamber.

DETAILED DESCRIPTION OF THE OPERATION OF THE QUENCH PRESS

The structure of the quench press 10 of the present invention in the preferred embodiment can better be understood by consideration of the operation of the quench press 10. With the quench press empty, all of the rams raised, the splash guard 26 lowered, and one of the access doors 35 opened, the quench press 10 is ready for a quenching cycle, provided, however, that proper dies have been set-up in the quench press 10 and tested for the correct adjustments.

A hot workpiece is placed into the quench press 10 and the automatic cycle is initiated. First the door or doors 35 will close and the splash guard 26 will move into position such as to form a quenching chamber by contacting the upper die plate or ram 24. Then the center ram 20, ram 23, and moveable plate 24 will move downward into position. Ram 20 will first contact the positive stop 31 and thus expand the conventional segmented die to the proper bore diameter generally conforming to the workpiece after heat treat size. The cylinder 15 exerts sufficient force to restrict the movement of the segmented dies when the workpiece is quenched and tries to contract because of thermal contractions.

Next, the second ram 23 and the third ram 24, moving downward into position, will cause the quenching dies to contact the hot workpiece, thereby causing the workpiece to be held flat or to whatever contour the dies and/or tooling are designed to produce. At this time the quenching oil or other quenching media is caused to fill the quenching chamber and continues to flow thru the passages to extract the heat from the workpiece at a controlled rate or rates until the part is sufficiently cooled. During the quenching, the upper rams, namely the second ram 23, and the third ram 24, are momentarily released several times to allow the workpiece to contract and shrink inwardly without restriction.

After the workpiece has cooled sufficiently, the flow of the quenching media is stopped, the center ram 20, the second ram 23, and the third ram 24 are raised to an "up" position. Then the quenching media is drained and the splash guard 26 is lowered and one of the access doors 35 is opened for removal of the workpiece. Such workpiece is removed and the quench press 10 is ready for another quenching cycle.

After inspection of the first piece, the shims 32 can be added to or remove from the positive stop 31 as required to decrease or increase, respectively, the bore diameter of the next workpiece and any successive workpiece. Provisions are also made for adjusting individually the pressure of each of the rams, the time of each element of the quenching cycle, the number of times the force is momentarily released, and the flow rate of the quenching media during each stage of the quenching cycle.

It will be understood that the above described embodiment is merely exemplary and that those skilled in the art may make many variations and modifications without departing from the spirit and scope of the present invention. All such modifications and variations are intended to be within the scope of the invention as defined in the appended claims.

We claim:

1. An improved quench press comprising:

(a) a frame, said frame including a base, a top plate spacially separate from said base and a plurality of elongated support elements secured therebetween;

(b) a first ram plate received between said top plate and said base and being associated with said support elements for aligned reciprocal movement therealong, said ram plate defining a passageway therethrough that is concentric to a vertical axis through said frame, said ram plate further having an annular collar secured to an underside of same, said collar being adapted for securement to a die of a predetermined design along an outer free end of same;

(c) a plurality of power exerting means associated with said ram plate to move said plate along said support elements and to apply pressure against a workpiece contacted by said die, said power exerting means for said plate being spaced about a circle concentric to said vertical axis;

(d) a central power exerting means located along said vertical axis and having a central ram operatively associated therewith for reciprocal movement with respect thereto, said central ram being operatively associated with said passageway for aligned reciprocal movement and having a generally conical shaped lower free end;

(e) a stationary workpiece support plate secured to said frame, said support plate being adapted for receipt of a lower die plate for said workpiece and being adapted for passageway of quench fluid therethrough;

(f) positive central ram stop means associated with said workpiece support plate along said vertical axis and operating independent of a workpiece being quenched;

(g) means operable to enclose an area around said workpiece support plate to define a quench chamber therewithin; and (h) means to supply quench liquid to said quench chamber for cooling a workpiece held between said rams and said workpiece support plate.

2. A quench press as defined in claim 1 wherein said power exerting means are fluid operated cylinders, and wherein said power exerting means associated with said ram plate have piston rods operatively associated therewith, one end of which is secured to said ram plate.

3. A quench press as defined in claim 1 wherein said stationary workpiece support plate has a radially expandable, segmented, annular die received thereon concentric to said vertical axis, said die being receivable within a workpiece to be quenched.

4. A quench press as defined in claim 3 wherein said positive central ram stop means is located within the annulus of said radially expandable, annular die and defines a conically shaped detent in an upper end of same that mates with the generally conically shaped lower free end of said central ram, and wherein said annulus of said expandable die has a generally similar conical taper such that mating contact between the conical free end of said central die and said central ram will cause radial expansion of said die to determine a proper inner diameter of the workpiece being quenched, whereby position of said positive central ram stop means will control the attainment of an accurate inner diameter of the workpiece.

5. A quench press as defined in claim 4 wherein said stationary workpiece support plate defines an opening concentric to said vertical axis for receipt of a portion of said positive central ram stop means, and further comprising shim means receivable between said support plate and an upper portion of said stop means to provide axial adjustment of same.

6. A quench press as defined in claim 1 comprising further at least one additional ram plate received beneath said first ram plate and being associated with said support elements for aligned reciprocal movement therealong, and a plurality of power exerting means associated with said second ram plate to move said second ram plate along said support elements, said second ram plate defining a passageway therethrough concentric to said vertical axis, said collar secured to said first ram plate passing through said passageway of said second ram plate with said die for said first ram plate being receivable therebeneath, said second ram plate further being adapted for securement of a die of a predetermined configuration to an underside of same, whereby during actuation of all of said power exerting means, a workpiece being held therebeneath receives pressure from said dies at the predetermined areas of contact.

7. A quench press as defined in claim 1 wherein said means to enclose an area around said workpiece support plate comprises a wall member that surrounds said support plate, said wall member being operatively associated with said elongated support elements for reciprocal movement therealong and having power means associated therewith to move said wall means to and from a quench chamber defining position depending upon operation of the quench press.

8. A quench press as defined in claim 1 wherein side walls are secured to said frame to enclose said quench press, and wherein a plurality of access doors are associated with said wall means to provide access to said quench press for operation of same.

9. An improved quench press for receiving a heated workpiece, holding said workpiece in a proper disposition, and providing a quench liquid in contact with said workpiece for the proper cooling of same while said workpiece is being held in said proper disposition, comprising:

(a) means for supporting a lower side of said workpiece to be quenched;

(b) power means for engaging the upper surface of said workpiece and clamping same against said lower side support means, said lower side support means and said power means being adapted for passage of said quench liquid therearound and in contact with said workpiece being held therebetween; and (c) separate quench chamber wall means associated with one of said lower side support means and said power means, said quench chamber wall means being independently movable to and from a first position and a second position where said quench chamber wall means cooperates with said lower side support means and said power means to define a quench liquid chamber within which said workpiece may be quenched, and (d) independent means to move said quench chamber wall means between said first and second positions.

10. An improved quench press as defined in claim 9 wherein said power means for engaging the upper surface of said workpiece comprises a power operated ram located along a vertical axis through said press with said workpiece to be quenched being generally concentric to said vertical axis, said ram having a generally conical shaped outer free end.

11. An improved quench press as defined in claim 9 wherein said power means comprise a central fluid operated ram located along a vertical axis through said press, and wherein said workpiece being received for quenching is located generally concentric to said axis, a first ram plate associated with a plurality of fluid operated piston rods located in a circle concentric to said vertical axis, said ram plate defining a central ram passageway therethrough and being adapted for aligned reciprocal movement with respect to said vertical axis, said ram plate having a collar secured to an underside of same, said collar depending downwardly along a path of travel of said central ram and being adapted for securement of a workpiece engaging die of a predetermined configuration to an outer free end of same, and a second ram plate located beneath said first ram plate, said second ram plate being operatively associated with a plurality of fluid operated piston rods located in a circle concentric to said vertical axis and defining a passageway therethrough concentric to said vertical axis, through which said collar and said central ram pass, said second ram plate being adapted for securement of a workpiece engaging die of predetermined configuration to an underside of same and for aligned reciprocal movement with respect to said vertical axis.

12. A quench press as defined in claim 10 wherein said means for supporting a lower side of said workpiece comprise a stationary support plate, said support plate being adapted for securement to a radially expandable annular die that generally conforms to the interior of said workpiece, the annulus of said die having a configuration that mates with the outer free end configuration of said central ram, whereby upon contact with said central ram, said die will expand a predetermined amount depending upon the position of the ram to define the interior diameter of the workpiece, and wherein said means for supporting said lower side of said workpiece are provided with a positive stop means for said central ram located within the annulus of said expandable die, said positive stop means being axially adjustable with respect to said central ram to accurately limit the length of stroke of said ram, and thereby accurately determine the inside diameter of the workpiece being quenched.

13. An improved quench press for receiving and clamping a workpiece to be quenched while quenching fluid is brought into contact with same comprising:

(a) means for supporting a lower side of a workpiece to be quenched;

(b) power means for engaging said workpiece and clamping same against said lower side support means, said lower side support means and said power means being adapted for passage of said quench fluid around and in contact with a workpiece held therebetween; and (c) adjustable positive stop means located on said underside support means along a vertical axis through said press with respect to which the operative elements of said power means are concentric, said power stop means being engageable with at least a portion of said power means to limit movement of same, whereby critical dimensions of said workpiece may be maintained; and (d) means to circulate a quench fluid into contact with a workpiece to be quenched.

14. A quench press as defined in claim 13 wherein said lower side supporting means is adapted for securement of an annular, radially expandable die thereto, said die being concentric to said vertical axis, an upper portion of said die annulus defining a shape that mates with at least a portion of said power means to be radially expanded thereby, said positive stop means being located within said annulus of said radially expanding die.

15. A quench press as defined in claim 14 wherein said power means comprises a generally centrally located power ram located along said vertical axis, an outer free end of said power ram being generally conically shaped, and wherein an upper portion of said radially expandable die is generally conically shaped to mate with said outer free end of said centrally located ram, a first ram plate with fluid operated piston rod means associated therewith, said first ram plate being adapted for aligned axial movement with respect to said vertical axis and defining a passageway concentric to said vertical axis, said plate having a collar secured to an underside of same around said passageway, said collar extending downwardly therefrom and being adapted for receipt of a workpiece engaging die of a predetermined configuration at a lower free end of same, and a second ram plate, located beneath said first ram plate, said second ram plate being operatively associated with power operated piston rods for aligned axial movement with respect thereto, said second ram plate defining a passageway therethrough concentric to said vertical axis and through which said central ram and said collar pass, said second plate being adapted for receipt of a workpiece engaging die of a predetermined configuration to the underside of same such that said central ram, and said first and second plates may be moved into a clamping position against said workpiece to hold same against distortion during quenching.

16. A quench press as defined in claim 15 further comprising independently operable means for defining an enclosed quench chamber between said lower side workpiece support and said power means, said independently operable chamber defining means being operatively associated with means to move same from a first position to a second position in which a quench chamber is defined.

17. A quench press as defined in claim 16 wherein an upper portion of said positive stop means defines a configuration that mates with the outer free end of said central ram to positively align said ram with respect to said workpiece during movement of said central ram.

18. A quench press as defined in claim 17 wherein said lower side support means defines an opening concentric to said vertical axis through which a portion of said positive stop means freely passes, and further comprising means locateable between said lower side support means and said positive stop means to locate said positive stop means at a predetermined position with respect to said central ram.

* * * * *